US008526846B2

(12) United States Patent
Horikawa

(10) Patent No.: US 8,526,846 B2
(45) Date of Patent: Sep. 3, 2013

(54) PROCESS CARTRIDGE AND IMAGE FORMING APPARATUS

(75) Inventor: Tadashi Horikawa, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 142 days.

(21) Appl. No.: 13/275,195

(22) Filed: Oct. 17, 2011

(65) Prior Publication Data

US 2012/0099903 A1 Apr. 26, 2012

(30) Foreign Application Priority Data

Oct. 22, 2010 (JP) ..... 2010-237466

(51) Int. Cl.
*G03G 15/08* (2006.01)

(52) U.S. Cl.
USPC ..... 399/106; 399/258; 399/262

(58) Field of Classification Search
USPC ..... 399/106, 111, 119, 258, 262
See application file for complete search history.

(56) References Cited

U.S. PATENT DOCUMENTS 6,058,278 A * 5/2000 Tsuda et al. ..... 399/106
6,512,903 B2 * 1/2003 Chadani ..... 399/106

FOREIGN PATENT DOCUMENTS

JP 2005-077742 3/2005
JP 2006-276489 10/2006

* cited by examiner

*Primary Examiner* — Hoang Ngo
(74) *Attorney, Agent, or Firm* — Canon U.S.A., Inc., IP Division

(57) ABSTRACT

A process cartridge includes an electrophotographic photosensitive member, a developing roller, a cleaning blade, a developer container including an opening, a developer conveyance member, a driving force transmission member having a driving force transmitted from the developer conveyance member, a seal member configured to seal the opening, and a winding member configured to wind the seal member such that the opening is opened, and the driving force transmission member is configured to take a first position at which the driving force is not transmitted to the winding member and a second position at which the driving force is transmitted to the winding member, and wherein the driving force transmission member is further configured to move from the first position to the second position after rotation of the developer conveyance member.

8 Claims, 8 Drawing Sheets

PROCESS CARTRIDGE AND IMAGE FORMING APPARATUS

BACKGROUND OF THE INVENTION

1. Field of the Invention

One of the aspects of the present invention relates to a process cartridge and an image forming apparatus. The image forming apparatus of the present invention forms an image on a recording medium using electrophotographic image forming process. The image forming apparatus is, for example, an electrophotographic copying machine, an electrophotographic printer (e.g., a light-emitting diode (LED) printer, a laser beam printer), and an electrophotography facsimile apparatus.

The recording medium is a medium on which an image is formed and is, for example, a recording sheet, an overhead projector (OHP) sheet, or the like. Further, the process cartridge is a cartridge having a processing unit and an electrophotography photosensitive drum (hereinafter referred to as a "photosensitive drum") integrated into one unit detachably attached to the image forming apparatus. The processing unit integrated in the process cartridge is at least one unit out of a charging unit, a developing unit, and a cleaning unit. Thus, a cartridge having at least a developing unit, as the processing unit, and a photosensitive drum integrated into one unit and is detachably attached to the image forming apparatus is included in the process cartridge.

2. Description of the Related Art

A process cartridge detachably attached to an image forming apparatus includes a cleaning unit and a developing unit. The cleaning unit generally includes a photosensitive drum and a cleaning unit. The developing unit includes a developing roller configured to supply developer to a photosensitive drum, a developer supplying unit including a developer supply roller configured to supply the developer to the developing roller, and a developer container which contains the developer.

The developer supplying unit and the developer container are separated by a partition. The partition is provided with an opening to connect the developer supplying unit and the developer container. Through the opening, the developer in the developer container is conveyed to the developer supplying unit by a developer conveyance member provided in the developer container.

When the process cartridge is in the unused state, the opening portion of the developer container is hermetically sealed by a seal member. One end of the seal member is joined to a handle member. When the user mounts the process cartridge to the image forming apparatus main body, the user pulls the handle member to remove the seal member, and the opening portion is opened.

In addition to the above-described configuration, there is proposed a configuration where the seal member is wound after the process cartridge is mounted to the image forming apparatus main body. According to this configuration, a winding member that winds the seal member is provided on the process cartridge. When the winding member receives a drive force from a drive source provided on the image forming apparatus main body, the winding member automatically winds up the seal member and opens the opening portion.

However, if the winding member that winds up the winding member of the seal member and the developer conveyance member are driven by one drive source provided on the image forming apparatus main body, the increase in the load torque of the process cartridge needs to be considered.

Specifically, there are two types of load torque. One is a load torque which is produced when the winding member is driven and the seal member is removed from the opening portion. The other is a load torque which is produced when the developer conveyance member is driven. In the case of the process cartridge in unused state, the developer may be clumped in the developer container due to vibration during distribution. If the developer conveyance member is driven when the developer is clumped in the developer container, a greater load torque than usual will be necessary to unwind the clumped developer.

Considering the load torque, if a drive source that can produce a larger torque is used in the image forming apparatus, the size of the apparatus will be increased or the cost will be increased. Thus, Japanese Patent Application Laid-Open No. 2005-077742 discusses an image forming apparatus which winds the seal member before driving the developer conveyance member when the seal member of the process cartridge in the unused state is wound automatically.

According to such a configuration, the timing of elevation of the load torque due to the winding of the seal member and the timing of elevation of the load torque due to the driving of the developer conveyance member can be staggered. Accordingly, the load of the drive source of the image forming apparatus can be reduced, and thus downsizing of the drive source of the image forming apparatus can be realized. This also leads to downsizing of the apparatus and cost reduction.

However, the conventional configuration has the following drawbacks. Generally, a cleaning unit of a process cartridge includes a cleaning member used for cleaning the surface of the photosensitive drum. The cleaning member is generally a rubber blade which is formed along the longitudinal direction of one end of a sheet metal. The rubber portion of the cleaning member abuts on the surface of the cylindrical photosensitive drum. Further, the cleaning member is arranged such that it abuts on the photosensitive drum in a direction opposite to the rotation direction.

If the photosensitive drum is continuously driven in a state where the developer is not on the contact portion of the photosensitive drum and the cleaning member, slide friction between the photosensitive drum and the cleaning member increases, and burrs may be generated in the rubber portion of the cleaning member.

However, if the image forming apparatus is a type that winds the seal member, the developer is not transmitted to the developing roller until the seal member is wound. Thus, the photosensitive drum will be rotated without the developer between the cleaning member and the photosensitive drum. Accordingly, there is threat that burrs of the cleaning member may be occurred.

Further, if the image forming apparatus is the type described above in which the seal member is wound before the drive of the developer conveyance member, the timing the developer is conveyed to the developing roller by the developer conveyance member further delay. This is further disadvantageous to the generation of burrs of the cleaning member.

Thus, according to the conventional configuration, to prevent the generation of burrs of the cleaning member when the winding of the seal member is performed, a sliding agent is applied to the cleaning member or a material that can reduce the slide friction is used on the surface of the photosensitive drum.

SUMMARY OF THE INVENTION

One of the aspects of the present invention is directed to a method for staggering a timing of elevation of the load torque due to winding of a seal member of a process cartridge in unused state and a timing of elevation of the load torque due to driving of a developer conveyance member.

Further, one of the aspects of the present invention is directed to a developing unit, a process cartridge, and an electrophotographic image forming apparatus which can prevent generation of burrs of a cleaning member.

According to an aspect of the present invention, a process cartridge mountable to and removable from an image forming apparatus main body includes an electrophotographic photosensitive member, a developing roller configured to develop an electrostatic latent image formed on the electrophotographic photosensitive member by a developer, a cleaning blade configured to remove the developer from the electrophotographic photosensitive member, a developer container including an opening through which the developer is supplied to the developing roller and configured to contain the developer, a developer conveyance member rotatably supported by the developer container and configured to convey the developer to the developing roller, a driving force transmission member having a driving force transmitted from the developer conveyance member, a seal member configured to seal the opening, and a winding member configured to wind the seal member such that the opening is opened, and the driving force transmission member is configured to take a first position at which the driving force is not transmitted to the winding member and a second position at which the driving force is transmitted to the winding member, and the driving force transmission member is further configured to move from the first position to the second position after rotation of the developer conveyance member.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 2:
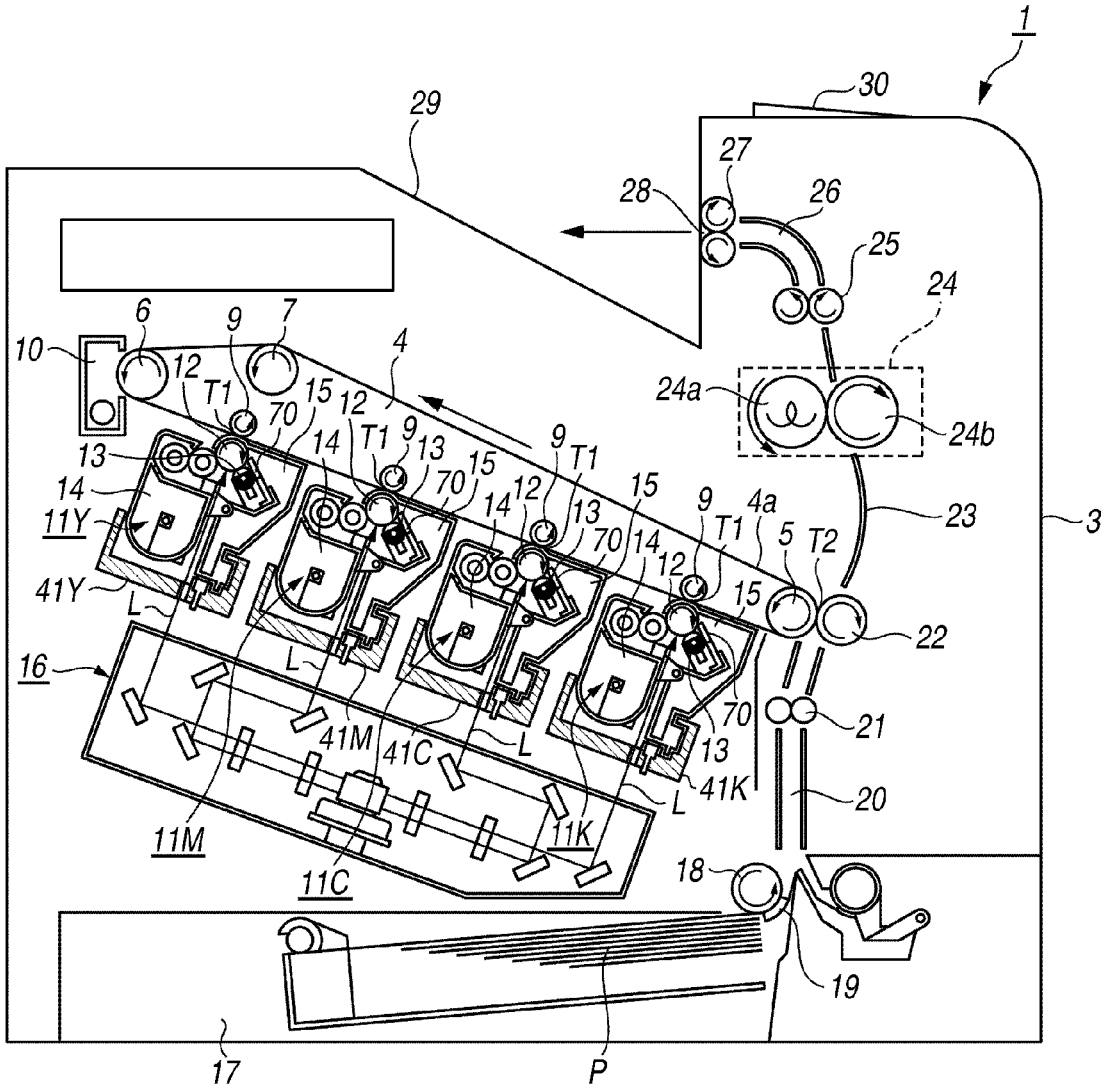
FIG. 2 is a cross-sectional drawing of an image forming apparatus in an image forming state according to an exemplary embodiment of the present invention.

First, overall configuration of the image forming apparatus will be described with reference to FIG. 2. FIG. 2 is a cross-sectional drawing of the image forming apparatus of the present exemplary embodiment. The image forming apparatus is in an image forming state.

An image forming apparatus 1 illustrated in FIG. 2 includes four process cartridges 11 (11Y, 11M, 11C, and 11K) arranged parallel with being slanted with respect to horizontal direction. Each of the process cartridges 11 can be independently detachably attached to an apparatus main body 3 of the image forming apparatus 1. The apparatus main body 3 is the portion which is left when the process cartridge 11 is removed from the image forming apparatus 1.

When a user detachably attaches the process cartridge 11 (hereinafter simply referred to as the cartridge 11) to the image forming apparatus 1, the user moves the cartridge 11 in the axial direction of a photosensitive drum 12 as an electrophotographic photosensitive member. In the descriptions below, the axial direction of the photosensitive drum 12 is referred to as the longitudinal direction and the direction perpendicular to the axial direction of the photosensitive drum 12 is referred to as the lateral direction. Further, regarding the image forming apparatus 1, the upstream side of the cartridge 11 with respect to the inserting direction is referred to as the front side and the downstream side of the cartridge 11 with respect to the inserting direction is referred to as the rear side. The inserting direction of the cartridge will be described below. The left and the right sides referred to in the present embodiment are the left and the right sides when the apparatus is viewed from the front.

Further, in FIG. 2, each of the cartridges 11Y, 11M, 11C, and 11K forms an image by a developer of each of the colors yellow, magenta, cyan, and black. These colors correspond to the color separation component colors of a full-color image. The cartridge 11 includes the photosensitive drum 12. Further, electrophotographic processing units including a charge roller (charging unit) 13, a developing unit 14, and a cleaning unit 15 are arranged about the photosensitive drum 12. Additionally, a laser scanner unit 16 is provided under the photosensitive drum 12 of the apparatus main body 3.

Above the photosensitive drum 12, there is provided an intermediate transfer belt unit (a belt-type transfer unit, a transfer conveying unit) 4. The intermediate transfer belt unit 4 includes a secondary transfer inner roller 5 arranged on the right side of the unit, and a driven roller 6 arranged on the left side of the apparatus, a tension roller 7 arranged near the driven roller 6, and an intermediate transfer belt 4*a* which is stretched and supported by the three rollers. The intermediate transfer belt (hereinafter, the belt) 4*a* is a flexible endless belt. The above-described three rollers 5, 6, and 7 are parallelly arranged in the front/back direction corresponding to the rotation shaft line direction. A The tension roller 7 is urged and transferred upward so that tension is applied to the belt 4*a*.

At the inside of the belt 4*a* on the lower side between the driven roller 6 and the secondary transfer inner roller 5, there are parallelly provided four primary transfer rollers 9, being a first to a fourth primary transfer rollers (primary transfer units), along the belt 4*a* with a predetermined interval in between from the left side to the right side in the front/back direction corresponding to the rotation shaft line direction. A portion where the belt 4*a* comes into contact with the photosensitive drum 12, in the portion where a primary transfer roller 9 is arranged, is referred to as a primary transfer portion T1. A belt cleaning unit 10 is provided at the outside of a curved portion of the belt 4*a* at the driven roller 6. Further, a secondary transfer outer roller 22 is provided at the outside of a curved portion of the belt 4*a* at the secondary transfer inner roller 5. The portion where the belt 4*a* comes into contact with the secondary transfer outer roller 22 is referred to as a secondary transfer portion T2.

A paper cassette 17 which contains a recording medium P is set under the apparatus main body 3. Further, a recording medium conveying unit is provided along the path from the paper cassette 17 to the upper side of the apparatus main body. The recording medium conveying unit includes a pick up roller 18 arranged above the paper cassette 17, a separation pad 19, a conveyance path 20, a registration roller pair 21, and a conveying guide 23. These components are arranged in this order from the upstream to the downstream regarding the conveying direction of the recording medium P.

Next, the image forming operation is described. First, the each photosensitive drum 12 is rotated according to the image forming timing and the surface of the photosensitive drum 12 is evenly charged by the charge roller 13. Then the each photosensitive drum 12 is selectively exposed to the laser light from the laser scanner unit 16. Accordingly, an electrostatic latent image is formed on the photosensitive drum 12. The developing unit 14 allows developer to adhere to the electrostatic latent image and develops the electrostatic latent image. After then, a bias having opposite polarity of the developer image, is applied to the primary transfer roller 9. The processing above is performed for each of the photosensitive drum 12 of each station. The developer images are sequentially superimposed and transferred onto the belt 4*a*, so that a full-color unfixed developer image is formed. This unfixed developer image is conveyed to the secondary transfer portion T2 by the rotation of the belt 4*a*.

On the other hand, the recording medium P in the paper cassette 17 is picked up one by one by the pickup roller 18 and the separation pad 19 and conveyed to the conveyance path 20. Then, the recording medium P is conveyed to the secondary transfer portion T2 at predetermined timing by the registration roller pair 21. After then, by an application of a transfer bias to the secondary transfer outer roller 22, each color developer image formed on the belt 4*a* is secondary transferred onto the recording medium P collectively. In this manner, an unfixed color image is formed on the recording medium P. Then, the recording medium P, which comes out from the secondary transfer portion T2, is separated from the belt 4*a* and conveyed to a fixing unit 24 along the conveying guide 23.

The developer image is fixed onto the recording medium P by an application of heat and pressure by a heat roller 24*a* and a pressure roller 24*b*. After then, the recording medium P is conveyed through a first discharge roller pair 25, a conveyance path 26, and a second discharge roller pair 27, and finally discharged from a discharge port 28 onto a discharge tray 29 at the upper portion of the apparatus. On the other hand, after the developer image is transferred onto the belt 4*a*, the photosensitive drum 12 allows the developer, which is left untransferred on the surface of the photosensitive drum 12 after the primary transfer, to be removed by a cleaning blade 70, which is a cleaning member of the cleaning unit 15, and prepares for the next imaging process. Similarly, after the recording medium P is separated from the belt 4*a*, the belt 4*a* allows the developer, which is left untransferred on the belt 4*a* after the secondary transfer, to be removed by the belt cleaning unit 10, and prepares for the next imaging process.

Figure 3:
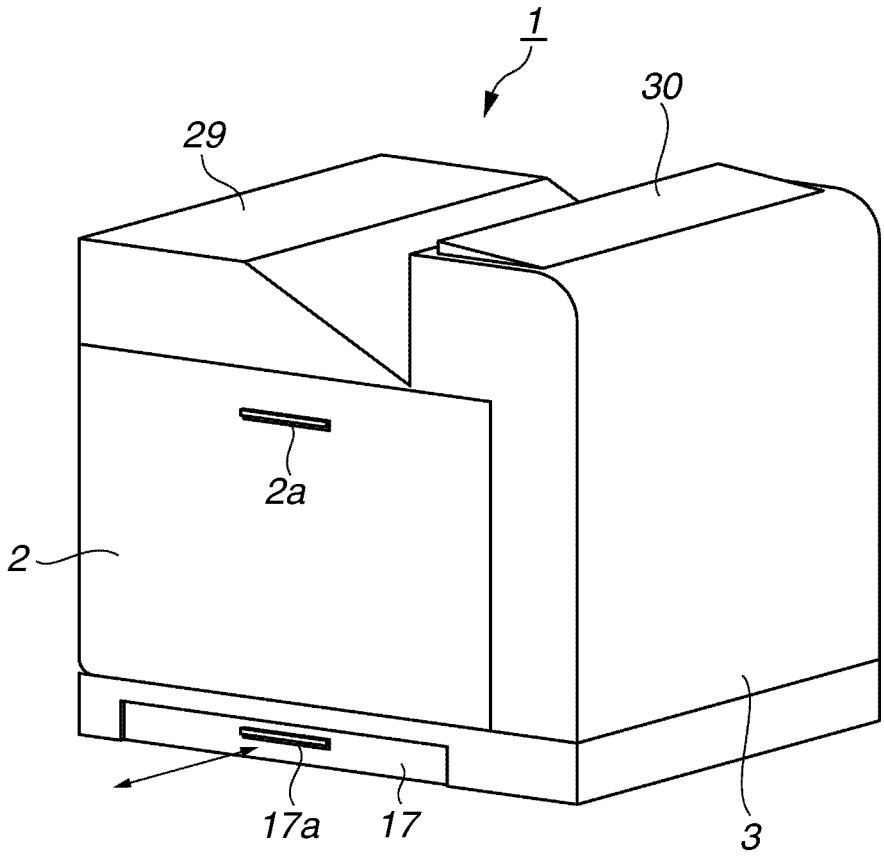
FIG. 3 is an oblique perspective view of the image forming apparatus according to the exemplary embodiment.
Figure 4:
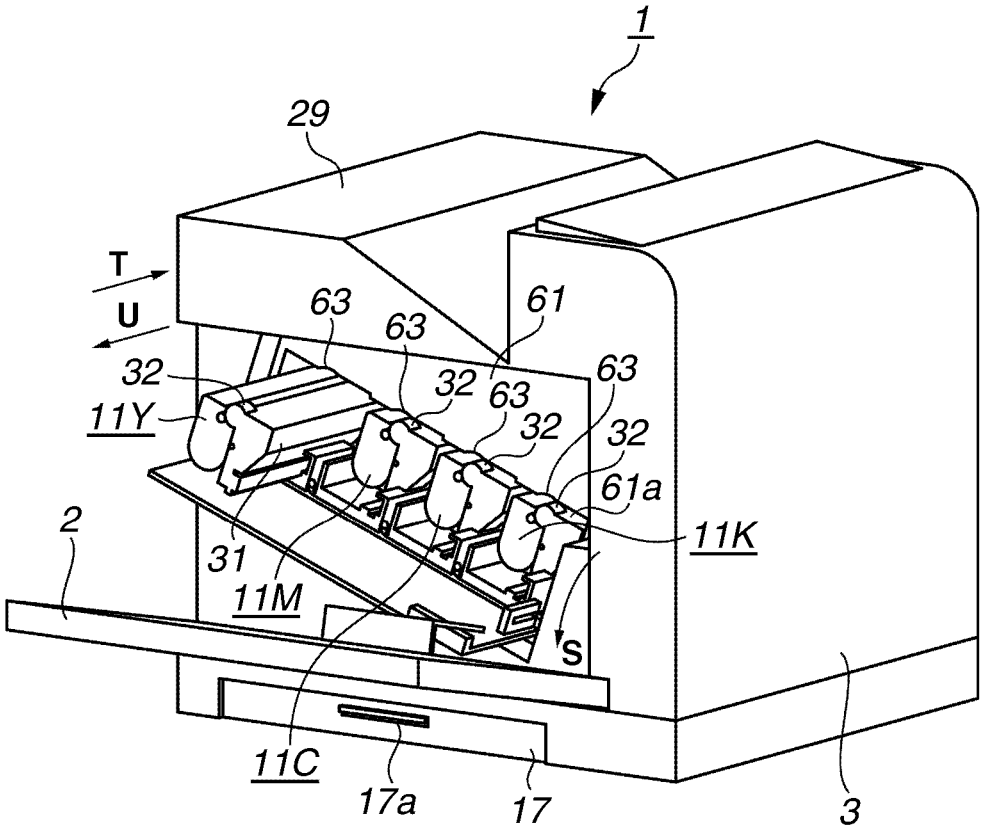
FIG. 4 is an oblique perspective view of the image forming apparatus in a state where an open/close door is opened.

Next, a mounting method of the process cartridge will be described. FIG. 3 is an oblique perspective view of the image forming apparatus 1. FIG. 4 is an oblique perspective view of the image forming apparatus 1 having an open/close door 2 opened and having one of the four cartridges 11 pushed in or taken out halfway.

As illustrated in FIG. 3, the image forming apparatus 1 of the present invention has a handle 2*a* provided on the open/close panel 2 which is on the front side of the image forming apparatus 1. The user pulls the open/close door 2 in the direction of the arrow S illustrated in FIG. 4 while holding the handle 2*a*, and then replaces the cartridge 11 from an opening portion 61*a*.

When the user mounts the cartridge, the user pushes the cartridge into the image forming apparatus 1 in the direction of the arrow T. Further, when the user removes the cartridge, the user pulls the cartridge out from the image forming apparatus 1 in the direction of the arrow U. In the following description, "front side" is the upstream of the arrow T direction and "rear side" is downstream of the arrow T direction.

Figure 5A:
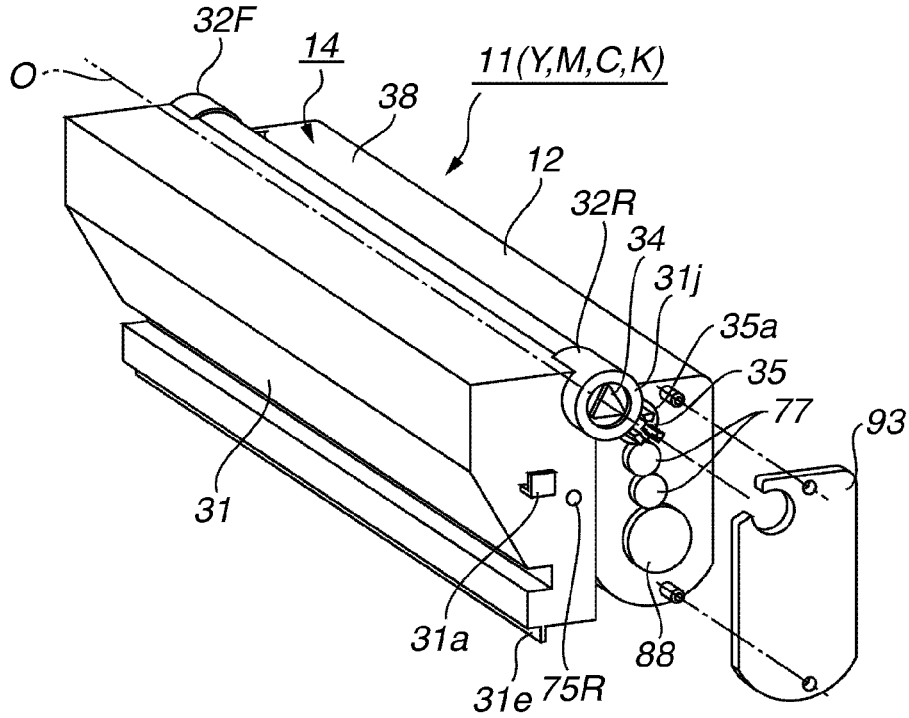
FIGS. 5A and 5B are oblique perspective views of the process cartridge.
Figure 5B:
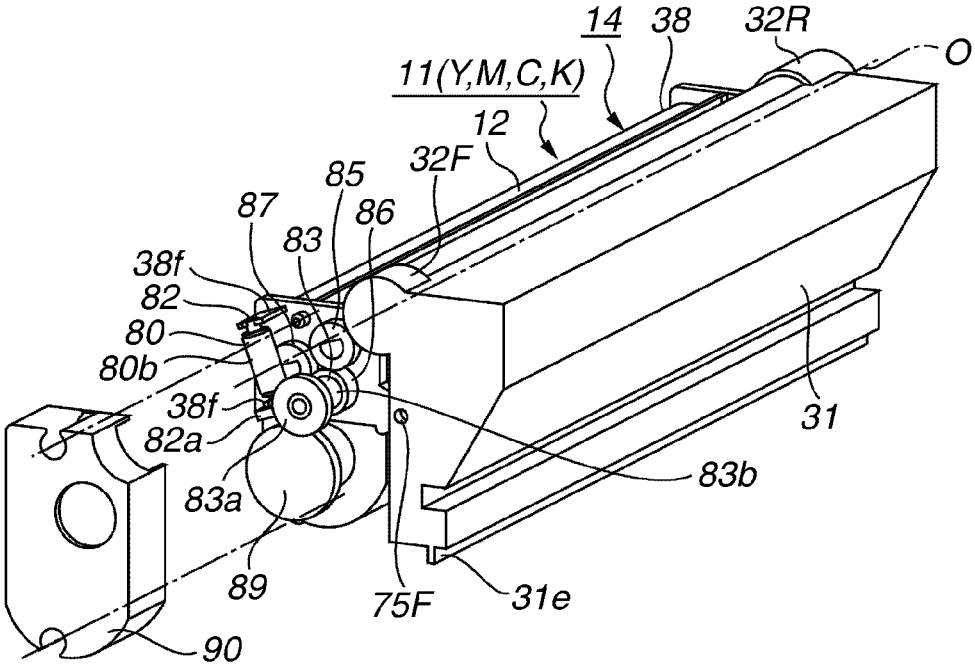
Figure 6:
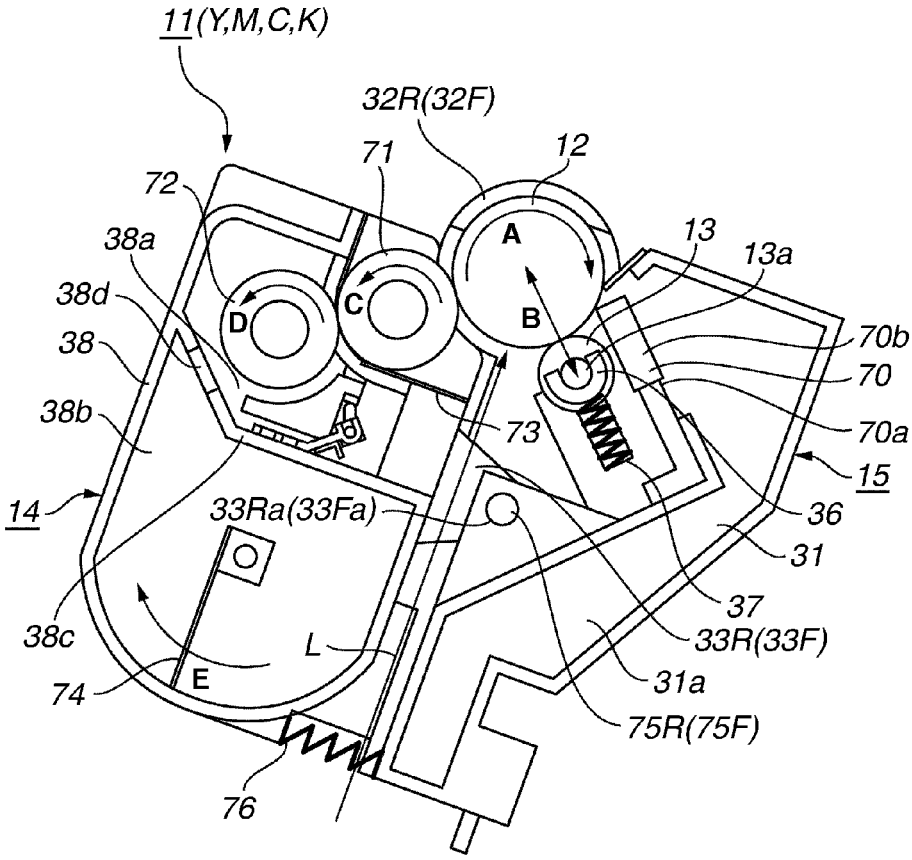
FIG. 6 is a cross-sectional drawing of the process cartridge which is in a state that imaging is possible.
Figure 7:
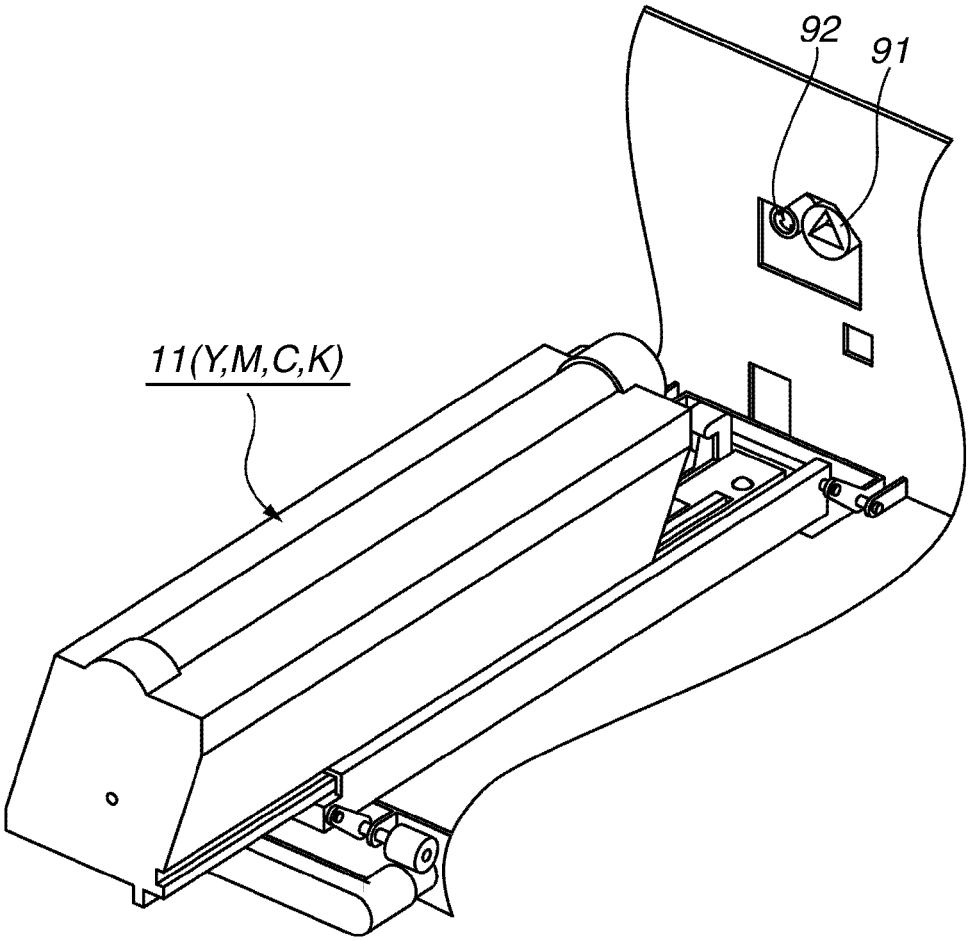
FIG. 7 is an oblique perspective view of a mounting portion of the process cartridge of the image forming apparatus.

Next, the cartridge 11 of the present embodiment will be described with reference to FIGS. 5A, 5B, 6, and 7. FIG. 5A is an oblique perspective view of the rear side of the cartridge having a rear side cover member removed viewed from the mounting direction. FIG. 5B is an oblique perspective view of the front side of the cartridge having a front side cover member removed viewed from the mounting direction. FIG. 6 is a cross section of the cartridge 11 mounted to the apparatus main body 3. Image forming is possible regarding the cartridge 11 in this state. FIG. 7 is an oblique perspective view of a cartridge mounting portion of the image forming apparatus 1.

The cartridge 11Y that contains yellow developer, the cartridge 11M that contains magenta developer, the cartridge 11C that contains cyan developer, and the cartridge 11K that contains black developer have the same configuration.

As illustrated in FIG. 5A, the direction of the rotation shaft line O of the photosensitive drum 12 is the longitudinal direction of the cartridge 11. At the end of the rear side of a cleaning frame body 31 viewed from the cartridge mounting direction, there are provided a drum drive coupling 34, a development drive coupling 35, and a regulating portion 31*a*. The drum drive coupling 34 is a drum driving force receiving unit that receives a driving force that rotates the photosensitive drum 12. The driving force is provided from the apparatus main body 3. The development drive coupling 35 is a developing roller driving force receiving unit that receives a driving force that rotates a developing roller 71 of the developing unit 14. The driving force is provided from the image forming apparatus 1.

As illustrated in FIG. 6, the cartridge 11 is separated into two units. The cleaning unit 15 includes the photosensitive drum 12, the charge roller 13, and a cleaning member 70. The developing unit 14 includes the developing roller 71.

The photosensitive drum 12 is rotatably set on the cleaning frame body 31 of the cleaning unit 15 via bearing members 32 (32F and 32R). Further, the developer remaining on the surface of the photosensitive drum 12 is removed by the cleaning member 70. The removed developer falls in a removed developer container 31*a*. The cleaning member 70 is formed of an L-shaped plate 70*a* with a rubber portion 70*b* integrally formed with the L-shaped plate along thereof in the longitudinal direction. As illustrated in FIGS. 5A and 5B, the rubber portion 70*b* of the cleaning member 70 is arranged along the photosensitive drum 12 in the longitudinal direction in such a manner that the rubber portion 70*b* comes into contact with the photosensitive drum 12 in the direction opposite to the rotation direction (direction of arrow A in FIG. 6) of the photosensitive drum 12.

Further, as illustrated in FIG. 7, the image forming apparatus 1 includes a drum coupling 91 that transmits the driving force generated by a drive motor (not illustrated) being a drive source to the cleaning unit 15. The drum coupling 91 and the drum drive coupling 34 of the cleaning unit 15 are in engagement. The drive force which is generated by the drive source and transmitted via the drum drive coupling 34 rotates the photosensitive drum 12 according to the image forming operation.

A charge roller bearing 36 is fixed to the cleaning frame body 31 in such a manner that it can move in the direction of the arrow B. A shaft 13*a* of the charge roller 13 is rotatably fixed to the charge roller bearing 36. The charge roller bearing 36 is pressed against the photosensitive drum 12 by a charge roller pressure application member 37. The charge roller 13 is driven to rotate by the rotation of the photosensitive drum 12.

As illustrated in FIG. 6, the developing unit 14 includes the developing roller 71, which comes into contact with the photosensitive drum 12 and rotates in the direction of the arrow C, and a development frame body 38. The developing roller 71 is rotatably supported by the development frame body 38 via development bearing members 33F and 33R provided on both sides of the development frame body 38.

Further, a developer supply roller 72 and a developing blade 73 are provided about the developing roller 71. The developer supply roller 72 contacts the developing roller 71 and rotates in the direction of the arrow D. The developing blade 73 regulates the developer layer on the developing roller 71. The development frame body 38 is separated into a developer supplying unit 38*a* and a developer container 38*b* by a partition 38*c*. The developer supplying unit 38*a* includes the developing roller 71, the developer supply roller 72, and the developing blade 73. The developer supplying unit 38*a* is in communication with the developer container 38*b* via an opening portion 38*d* provided in the partition 38*c*. The developer container 38*b* includes a developer conveyance member 74. The developer conveyance member 74 stirs the contained developer and conveys the stirred developer to the developer supply roller 72. The developer conveyance member 74 rotates in the direction of the arrow E, and the developer in the developer container 38*b* is conveyed to the developer supplying unit 38*a* via the opening portion 38*d*.

The developing unit 14 fits in holes 33Fa and 33Ra in the development bearing members 33F and 33R and is rotatably connected to the cleaning unit 15 by a shaft 75 (75F and 75R) fixed to the cleaning frame body 31. When the image forming is performed, since the developing unit 14 is urged by a pressure spring 76, the developing unit 14 rotates about the shaft 75 (75F and 75R), and the developing roller 71 comes into contact with the photosensitive drum 12.

As illustrated in FIG. 7, the image forming apparatus includes a development coupling 92. The development coupling 92 transmits the driving force transmitted from the drive motor (not illustrated) being the drive source to the development drive coupling 35 of the developing unit 14. The development drive coupling 35 is integrally connected to the end of the rear side of the developing roller 71 mounting direction. As illustrated in FIG. 5B, a developing roller gear 85 is integrally connected to the end of the front side of the developing roller 71 mounting direction. Further, as illustrated in FIG. 5B, a developer supply roller gear 87 is integrally connected to the front side of the developer supply roller 72 in the cartridge 7 mounting direction. A development idler gear 86 is rotatably supported at the end of the front side of the developing unit 14 in the cartridge 7 mounting direction.

The rotation of the developing roller 71 is started when the drive force is transmitted from the development drive coupling 35 to the development coupling 92. Then, as illustrated in FIG. 5B, the drive force is transmitted from the developing roller gear 85 provided on the end of the front side of the developing roller 71 to the developer supply roller gear 87 via the development idler gear 86. The developer supply roller gear 87 is integrally connected to the developer supply roller 72, so that the developer supply roller 72 also rotates when the developer supply roller gear 87 rotates. In order to protect the above-described gears and the like, a front side cover member 90 that covers the gears and the like is fixed to the developing unit 14 on the front side in the cartridge 7 mounting direction.

Next, the drive configuration of the developer conveyance member 74 will be described. As illustrated in FIG. 5A, a stirring idler gear 77 and a stirring gear 88 are provided on the rear side of the cartridge 11. The development drive coupling 35 includes a gear unit 35*a* which is in engagement with the stirring idler gear 77. The stirring gear 88 is integrally connected to the developer conveyance member 74. The drive force received by the development drive coupling 35 is transmitted to the stirring gear 88 via the stirring idler gear 77. Thus, when the development drive coupling 35 rotates, the developer conveyance member 74 also rotates. Further, as is the front side covered by the front side cover member 90, a rear side cover member 93 that protects the gears and the like is also fixed to the rear side of the developing unit 14.

Next, the seal configuration of the developer container 38*b* according to the present embodiment will be described with reference to FIG. 8.

Figure 8:
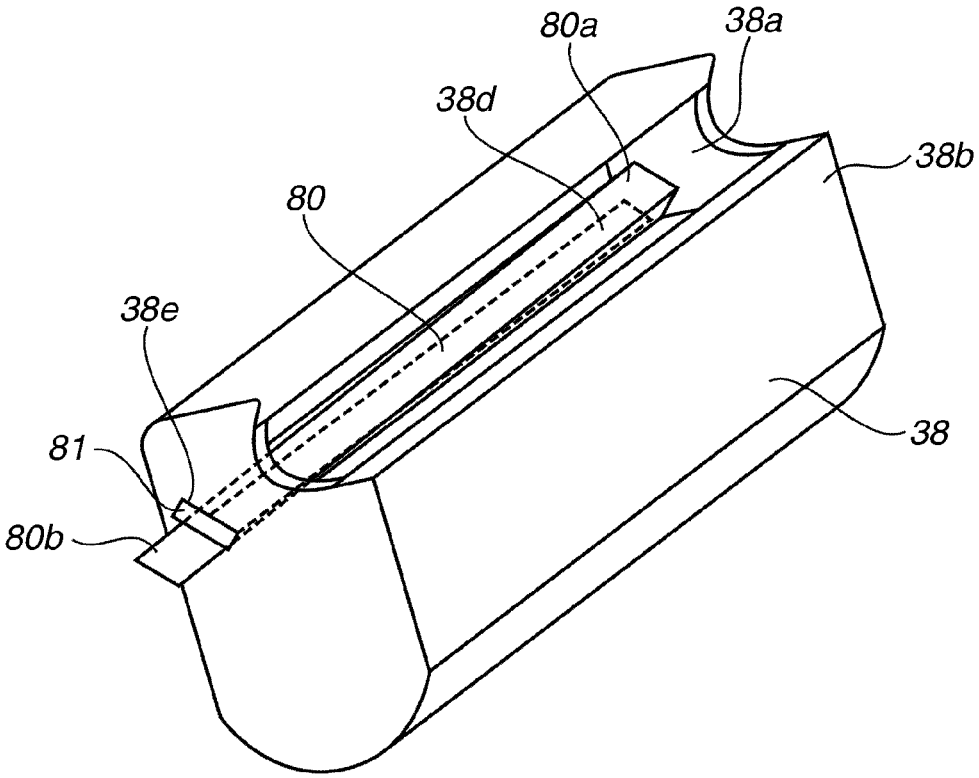
FIG. 8 is an oblique perspective view of a developer container to illustrate the configuration of winding of seal member.

FIG. 8 is an oblique perspective view of the developer container 38*b*. If the cartridge is in the unused state, the opening portion 38*d* of the developer container 38*b* is sealed by a seal member 80 so that the developer in the developer container 38*b* does not spill out of the cartridge 11. The seal member 80 is made of a sheet material and, as illustrated in FIG. 8, the seal is bonded to the entire perimeter of the opening portion 38*d* of the developer container 38*b* by thermal welding or vibration welding. Further, the seal member 80 is folded back at a folding portion 80*a*. An end 80*b*, which is the end of the folding portion, extends outward from a seal opening 38*e* provided on the front side of the developer supplying unit 38*a*. Further, a seal wiping member 81 is provided on the seal opening 38*e*. The seal wiping member 81 is used for removing the developer attached to the seal member 80.

Figure 1A:
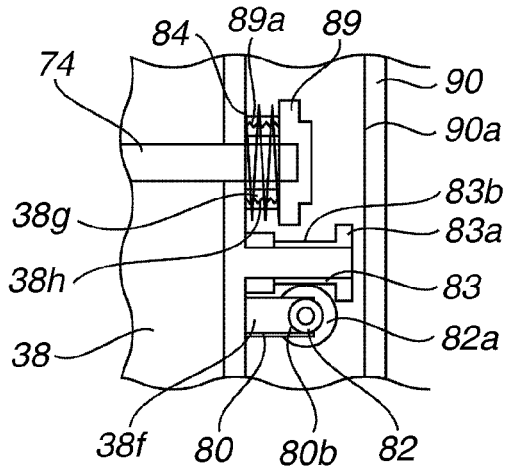
FIGS. 1A to 1C are partial sectional drawings of a process cartridge to illustrate the winding operation of the seal member.
Figure 1B:
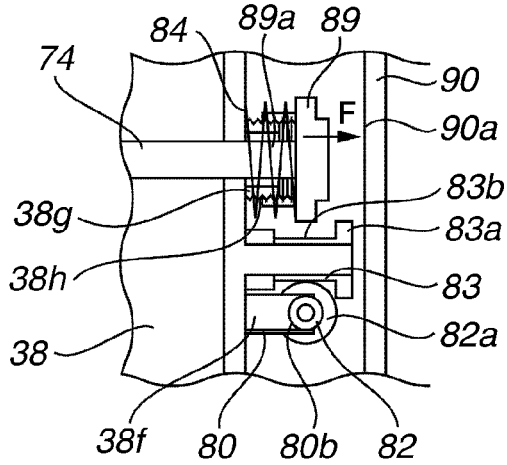

Next, the winding configuration of the seal member 80 according to the present embodiment will be described with reference to FIGS. 5B, 1A, and 1B. FIG. 5B is an oblique perspective view of the front side of the cartridge 11 in the mounting direction. FIGS. 1A and 1B are partial sectional drawings to illustrate the winding operation of the seal member 80.

As illustrated in FIG. 5B, the end 80*b* of the seal member 80 adheres to a winding member 82, which is a cylindrical member, with a two-sided tape or the like. The winding member 82 is rotatably supported by a winding support unit 38*f* provided on the front side of the cartridge 11 in the mounting direction of the developer container 38. Further, a winding gear unit 82*a* is provided on one end of the winding member 82. Furthermore, a winding idler gear 83 is rotatably supported by the developer container 38. The winding idler gear 83 includes an idler gear unit 83*a* and a worm gear unit 83*b*. The winding gear unit 82*a* is in engagement with the worm gear unit 83*b*.

A second stirring gear 89, which is a driving force transmission member, is provided on the front side of the developer container 38 in the cartridge 11 mounting direction. The second stirring gear 89 is integrally connected to the developer conveyance member 74. As illustrated in FIG. 1A, the second stirring gear 89 is rotatably supported by an attachment portion 38*g* fixed on the developer container 38. The attachment portion 38*g* includes a first screw portion 38*h*. Additionally, a second screw portion 89*a*, which corresponds to the first screw portion 38*h*, is provided on the inner perimeter of the second stirring gear 89. An urging member 84 is arranged between the developer container 38 and the second stirring gear 89.

The first screw portion 38*h* and the second screw portion 89*a* are in rotatably engagement with each other. When the second stirring gear 89 rotates, as illustrated in FIG. 1B, the second stirring gear 89 moves outward in the longitudinal direction of the development frame body 38 (in the direction of the arrow F). Further, as described above, the winding member 82 and the second stirring gear 89 are covered with the cover member 90 provided on the developing unit 14.

Figure 1C:
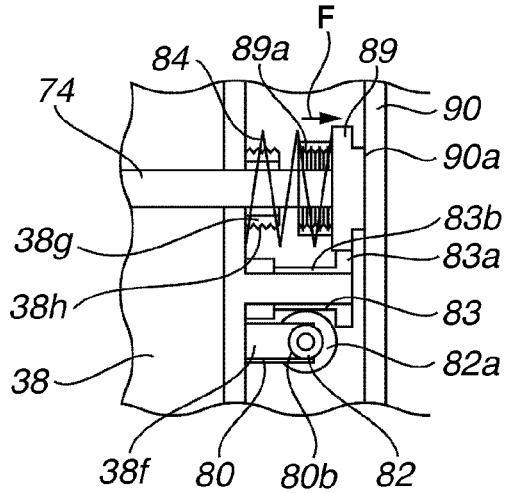

Next, the winding operation of the seal member 80 of the present embodiment will be described with reference to FIGS. 1A to 1C. FIGS. 1A to 1C are partial sectional drawings to illustrate the winding operation of the seal member 80.

As illustrated in FIG. 1A, when the cartridge 11 is in the unused state, the first screw portion 38*h* of the developer container 38 and the second screw portion 89*a* of the second stirring gear 89 are in engagement with each other. In this case, the second stirring gear 89 and the idler gear unit 83*a* of the winding idler gear 83 are not in engagement with each other. The position of the second stirring gear 89 in this case is referred to as a first position.

In this state, if the cartridge 11 is mounted to the apparatus main body 3, a driving force transmitted from the drive motor (not illustrated) being the drive source of the image forming apparatus 1 rotates the developer conveyance member 74 via the development drive coupling 35. In this case, the developer in the developer container 38*b* is stirred by the rotation of the developer conveyance member 74.

The rotation of the developer conveyance member 74 is transmitted to the second stirring gear 89 which is integrally connected to the developer conveyance member 74. After a predetermined number of rotations, as illustrated in FIG. 1B, the second stirring gear 89 moves outward with respect to the longitudinal direction of the development frame body 38 (in the direction of the arrow F). The position of the second stirring gear 89 in this case is referred to as a second position.

Then, when the first screw portion 38*h* and the second screw portion 89*a* are out of engagement with each other, as illustrated in FIG. 1C, the second stirring gear 89 moves in the direction of the arrow F by the urging force of the urging member 84 and abuts on an abutting face 90*a* at the front side cover member 90. In this case, the second stirring gear 89 engages the idler gear unit 83*a* of the winding idler gear 83 being the drive transmission member. In this manner, the drive of the second stirring gear 89 is transmitted to the winding member 82 via the winding idler gear 83, and the winding of the seal member 80 is started.

When the winding of the seal member 80 is started and the opening portion 38*d* is opened, according to the developer conveyance member 74, the developer in the developer container 38*b* is conveyed to the developer supplying unit 38*a*. The developer conveyed to the developer supplying unit 38*a* is further conveyed to the developing roller 71 via the developer supply roller 72, and supplied to the photosensitive drum 12. Then, the developer supplied to the photosensitive drum 12 works as a sliding agent that reduces the friction between the photosensitive drum 12 and the cleaning member 70 when the winding operation of the seal member 80 is performed.

As described above, the winding of the seal member is performed after the drive of the developer conveyance member is performed, so that the increase in the load torque of the cartridge can be suppressed.

Further, the winding of the seal is performed after the drive of the developer conveyance member, so that the developer can be supplied to the developing roller and the photosensitive drum earlier than when the drive of the developer conveyance member is performed after the winding of the seal member. The developer on the photosensitive drum serves as a sliding agent that contributes to reducing the friction between the photosensitive drum and the cleaning member. Thus, the configuration of the present exemplary embodiment is effective in preventing generation of burr of the cleaning member.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-237466 filed Oct. 22, 2010, which is hereby incorporated by reference herein in its entirety.

What is claimed is:

1. A process cartridge detachably attached to an image forming apparatus main body, the process cartridge comprising:

an electrophotographic photosensitive member;

a developing roller configured to develop an electrostatic latent image formed on the electrophotographic photosensitive member by a developer;

a cleaning blade configured to remove the developer from the electrophotographic photosensitive member;

a developer container including an opening through which the developer is supplied to the developing roller and configured to contain the developer;

a developer conveyance member rotatably supported by the developer container and configured to convey the developer to the developing roller;

a driving force transmission member having a driving force transmitted from the developer conveyance member;

a seal member configured to seal the opening; and a winding member configured to wind the seal member such that the opening is opened, wherein the driving force transmission member is configured to take a first position at which the driving force is not transmitted to the winding member and a second position at which the driving force is transmitted to the winding member, and wherein the driving force transmission member is further configured to move from the first position to the second position after rotation of the developer conveyance member.

2. The process cartridge according to claim 1, wherein the developer container includes a first screw portion, wherein the driving force transmission member includes a second screw portion which is in engagement with the first screw portion, and wherein when the driving force transmission member is at the first position, the first screw portion and the second screw portion are in rotatably engagement with each other, and when the driving force transmission member is at the second position, the first screw portion and the second screw portion go out of engagement with each other.

3. The process cartridge according to claim 1, further comprising a urging member configured to urge the driving force transmission member so that the driving force transmission member moves from the first position to the second position.

4. The process cartridge according to claim 1, wherein the winding member is a worm gear and the driving force is transmitted from the driving force transmission member to the winding member via an idler gear.

5. An image forming apparatus configured to form an image on a recording medium, the apparatus comprising:

a process cartridge mountable to and removable from an apparatus main body of the image forming apparatus, the process cartridge including:

an electrophotographic photosensitive member;

a developing roller configured to develop an electrostatic latent image formed on the electrophotographic photosensitive member by a developer;

a cleaning blade configured to remove the developer from the electrophotographic photosensitive member;

a developer container including an opening through which the developer is supplied to the developing roller and configured to contain the developer;

a developer conveyance member rotatably supported by the developer container and configured to convey the developer to the developing roller;

a driving force transmission member having a driving force transmitted from the developer conveyance member;

a seal member configured to seal the opening; and a winding member configured to wind the seal member such that the opening is opened, wherein the driving force transmission member is configured to take a first position at which the driving force is not transmitted to the winding member and a second position at which the driving force is transmitted to the winding member, and wherein the driving force transmission member is further configured to move from the first position to the second position after rotation of the developer conveyance member, and a conveying unit configured to convey the recording medium.

6. The image forming apparatus according to claim 5, wherein the developer container includes a first screw portion, wherein the driving force transmission member includes a second screw portion which is in engagement with the first screw portion, and wherein if the driving force transmission member is at the first position, the first screw portion and the second screw portion are rotatably engaged, and if the driving force transmission member is at the second position, the first screw portion and the second screw portion go out of engagement.

7. The image forming apparatus according to claim 5, further comprising a force application member configured to apply a force to the driving force transmission member so that the driving force transmission member moves from the first position to the second position.

8. The image forming apparatus according to claim 5, wherein the winding member is a worm gear and the driving force is transmitted from the driving force transmission member to the winding member via an idler gear.

* * * * *